US006412462B1

(12) United States Patent
Lichti et al.

(10) Patent No.: US 6,412,462 B1
(45) Date of Patent: Jul. 2, 2002

(54) CAM PHASER APPARATUS HAVING A STATOR INTEGRAL WITH A BACK PLATE OR A FRONT COVER PLATE

(75) Inventors: Thomas Howard Lichti, Fairport; Michael James Fox, Stafford; Gary John Deangelis, Spencerport, all of NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/484,800

(22) Filed: Jan. 18, 2000

(51) Int. Cl.[7] ..... F01L 1/34

(52) U.S. Cl. ..... 123/90.17; 74/568 R; 464/1; 464/2; 464/160

(58) Field of Search ..... 123/90.15, 90.16, 123/90.17, 90.31, 90.37; 277/370, 371, 394, 397, 399, 402, 500, 549, 551, 566, 572, 574; 74/568 R; 464/1, 2, 160

(56) References Cited

U.S. PATENT DOCUMENTS 2,339,042 A * 1/1944 Anderson ..... 92/125
4,817,504 A * 4/1989 Lieberman ..... 92/125
4,858,572 A 8/1989 Shirai et al.
5,450,825 A 9/1995 Geyer et al.
5,535,705 A 7/1996 Eguchi et al.
5,558,053 A 9/1996 Tortul
5,588,404 A 12/1996 Lichti et al.
5,666,914 A 9/1997 Ushida et al.
5,701,799 A * 12/1997 Granberg ..... 92/125
5,775,279 A 7/1998 Ogawa et al.
5,813,378 A 9/1998 Sato
5,839,346 A * 11/1998 Sekiya ..... 92/5 R
6,039,015 A 3/2000 Sato
6,186,103 B1 * 2/2001 Schafer ..... 123/90.17

* cited by examiner

*Primary Examiner*—Thomas Denion
*Assistant Examiner*—Jaime Corrigan
(74) *Attorney, Agent, or Firm*—John VanOphem

(57) ABSTRACT

A cam phaser wherein the stator is integral with either the back plate or the front cover plate. The integral stator may be formed by any desired forming technique, such as, for example, by machining, casting, welding, or injection molding. Preferably, however, the integral stator is formed in a single molding step by powdered metal forming using powdered aluminum. Cap seals are provided for sealing the hydraulic chambers of the cam phaser.

1 Claim, 4 Drawing Sheets

CAM PHASER APPARATUS HAVING A STATOR INTEGRAL WITH A BACK PLATE OR A FRONT COVER PLATE

TECHNICAL FIELD

The present invention relates to cam phasers for reciprocating internal combustion engines for altering the phase relationship between valve motion and piston motion; more particularly, to cam phasers having a vaned, hydraulically-rotatable rotor disposed in an internally-lobed stator to form actuation chambers therebetween; and most particularly to a cam phaser wherein a stator is integrally formed with either a back plate carrying drive means or a front cover plate.

BACKGROUND OF THE INVENTION

Cam phasers are well known in the automotive art as elements of systems for reducing combustion formation of nitrogen oxides (NOX), reducing emission of unburned hydrocarbons, improving fuel economy, and improving engine torque at various speeds. Typically, a cam phaser employs a first element driven in fixed relationship to the crankshaft and a second element adjacent to the first element and mounted to the end of the camshaft in either the engine head or block. A cam phaser is commonly disposed at the camshaft end opposite the engine flywheel, herein referred to as the "front" end of the engine. The first element is typically a cylindrical stator mounted onto a crankshaft-driven gear or pulley, the stator having a plurality of radially-disposed inwardly-extending spaced-apart lobes and an axial bore. The second element is a vaned rotor mounted to the end of the camshaft through the stator axial bore and having vanes disposed between the stator lobes to form actuation chambers therebetween such that limited relative rotational motion is possible between the stator and the rotor. The chambers are sealed at the rear typically by a gasket or O-ring between the stator and the back plate and at the front by a gasket or O-ring between a front cover plate and the stator.

Known cam phasers typically comprise these three basic chamber-forming elements: a stator, a rear cover plate (typically formed to include a drive pulley or sprocket), and a front cover plate. These three elements are manufactured separately, are carried in inventory as three distinct parts, and are assembled with two gaskets or O-rings as described above.

What is needed is an improved cam phaser wherein the stator is formed integrally with either the rear cover plate or the front cover plate, thereby eliminating one gasket or O-ring, reducing the total number of phaser parts, and eliminating a potential source of hydraulic leakage from the actuation chambers.

SUMMARY OF THE INVENTION

The present invention is directed to a cam phaser wherein the stator is integral with either the back plate or the front cover plate. The integral stator may be formed by any desired forming technique, such as, for example, by machining, casting, welding, or injection molding. Preferably, however, the integral stator is formed in a single molding step by powdered metal forming using powdered aluminum.

Also, the present invention provides for cap seals to be used in place of conventional sealing elements for sealing the hydraulic chambers of the cam phaser.

BRIEF DESCRIPTION OF THE DRAWINGS

The foregoing and other objects, features, and advantages of the invention, as well as presently preferred embodiments thereof, will become more apparent from a reading of the following description, in connection with the accompanying drawings in which.

DESCRIPTION OF THE PREFERRED EMBODIMENT

Figure 1:
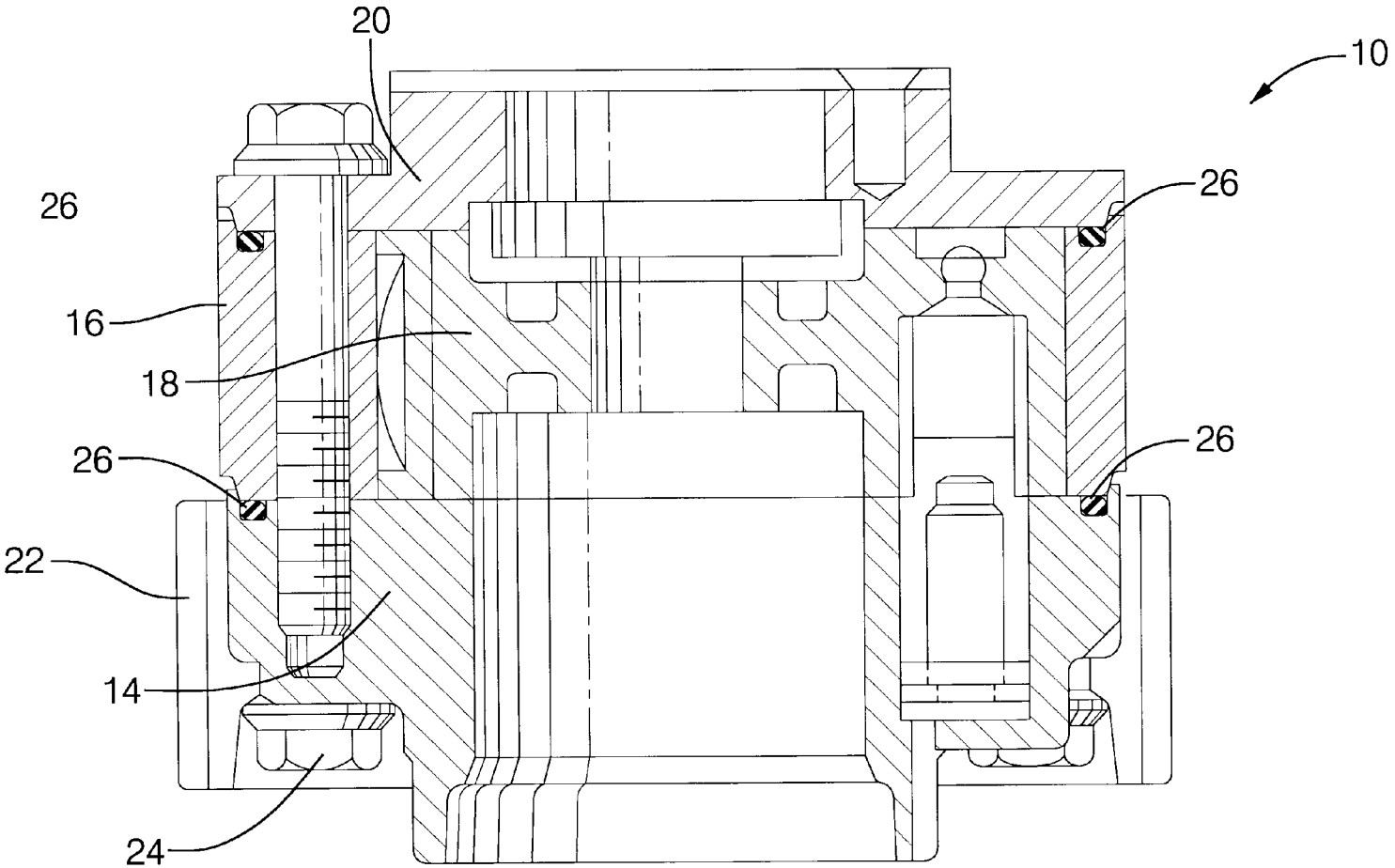
FIG. 1 is a cross-sectional view.
Figure 2:
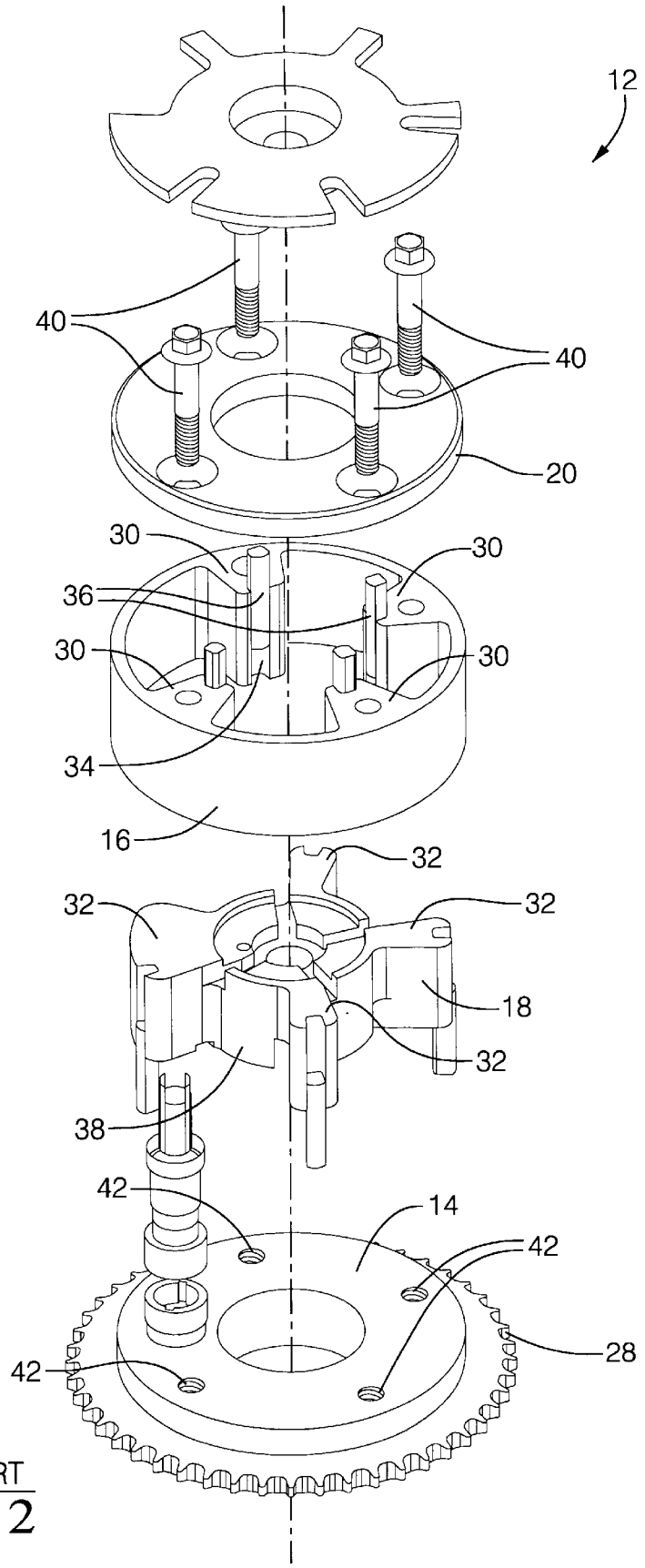
PRIOR ART FIG. 2
FIG. 2 is an exploded isometric view, of first and second prior art cam phasers, respectively, showing commonality of separate parts comprising back plate, front cover plate, stator, and rotor.

The benefits of the invention can be more fully appreciated by examining prior art rotors. Referring to FIGS. 1 and 2, prior art cam phasers 10 and 12 are manufactured, respectively, by Mitsubishi and Delphi. Phasers 10 and 12 include a back plate 14, stator 16, rotor 18, and front cover plate 20. Phaser 10 is provided with a ribbed drive wheel 22 bolted to back plate 14 by bolts 24. The front cover plate, stator, and back plate are sealed by O-rings 26. Phaser 12 is provided with a sprocketed drive wheel 28 integral with back plate 14, and is sealed between the similar elements by gaskets (not shown). Stator 16 is provided with inwardly-extending lobes 30 which, when the phaser is assembled, cooperate with outwardly-extending vanes 32 on rotor 18 to form a plurality of hydraulic chambers within the phaser for advancing and retarding the cam timing in known fashion. Stator lobes 30 are formed to have longitudinal slots 34 for receiving resilient seal elements 36 for sealing against the inner hub surface 38 of rotor 18. The assembled phaser is held together by throughbolts 40 extending through front cover plate 20, stator 16, and into threaded bores 42 in back plate 14.

Figure 3:
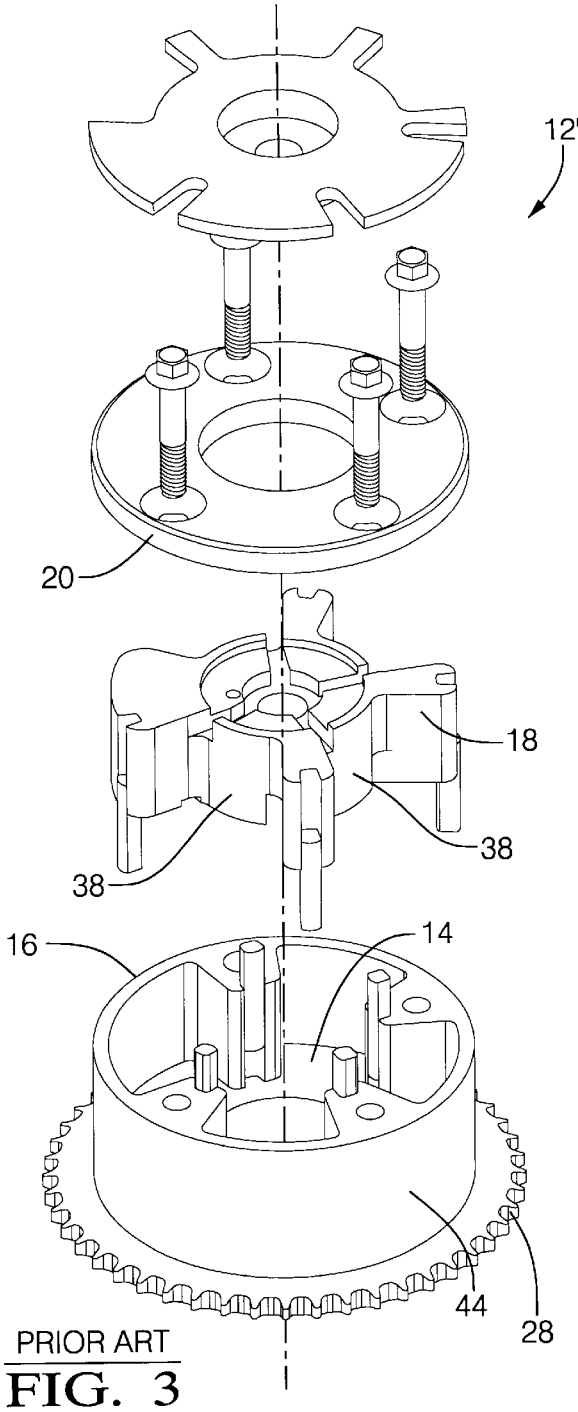
PRIOR ART FIG. 3
FIG. 3 is an exploded isometric view of a first embodiment of a cam phaser in accordance with the invention, showing an integral stator and back plate with drive sprocket.

Referring to FIG. 3, first embodiment 12' in accordance with the invention has all elements common with prior art phaser 12, except that back plate 14 (including sprocketed drive wheel 28) and stator 16 are combined into a single, integral back plate and stator element 44, thereby simplifying the assembly of the phaser, reducing the number of parts to be manufactured and inventoried, and eliminating the possibility of hydraulic leakage between the stator and the back plate.

Figure 4:
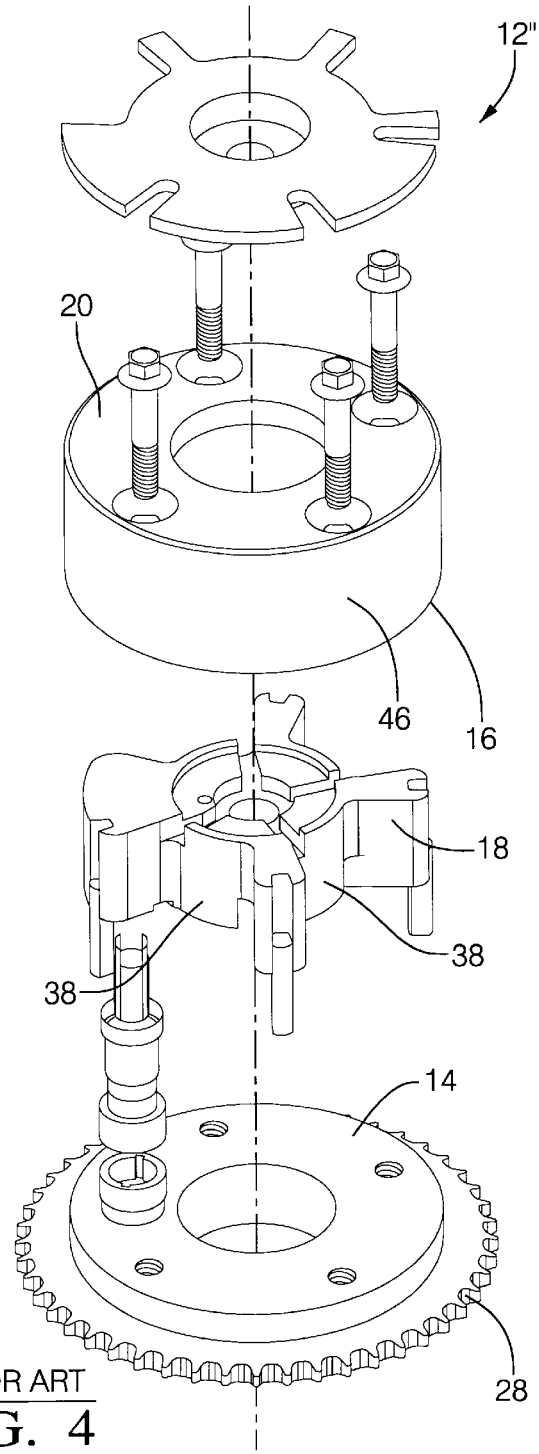
PRIOR ART FIG. 4
FIG. 4 is an exploded isometric view of a second cam embodiment of a cam phaser in accordance with the invention, showing an integral stator and front cover plate.

Similarly, referring to FIG. 4, second embodiment 12" in accordance with the invention has all elements common with prior art phaser 12, except that front cover plate 20 and stator 16 are combined into a single, integral front plate and stator element 46, thereby simplifying the assembly of the phaser, reducing the number of parts to be manufactured and inventoried, and eliminating the possibility of hydraulic leakage between the stator and the front cover plate.

Figure 6:
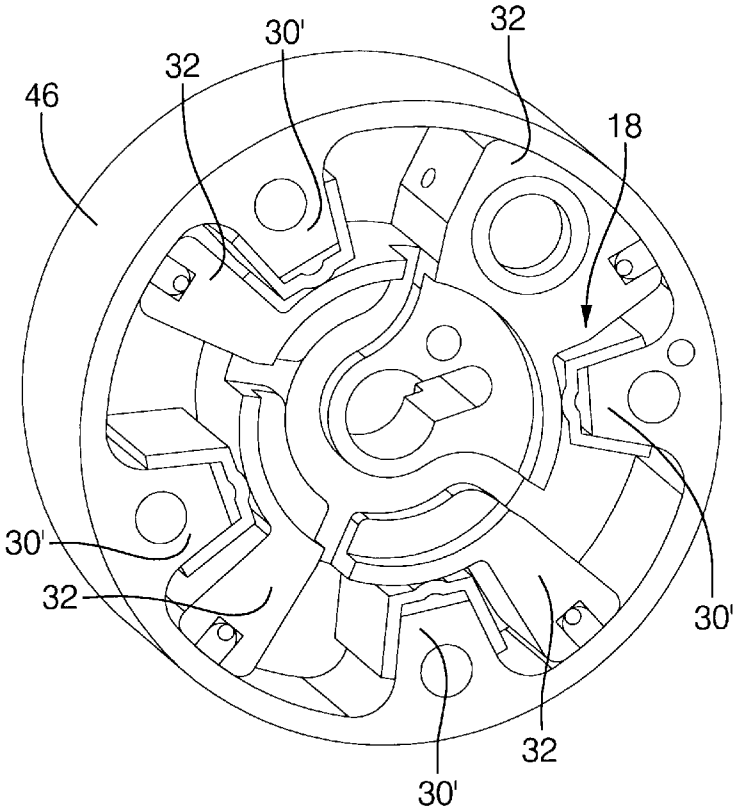
FIG. 6 is an isometric view like that shown in FIG. 5, showing the arrangement of a rotor disposed within the integral stator and front cover plate.
Figure 5:
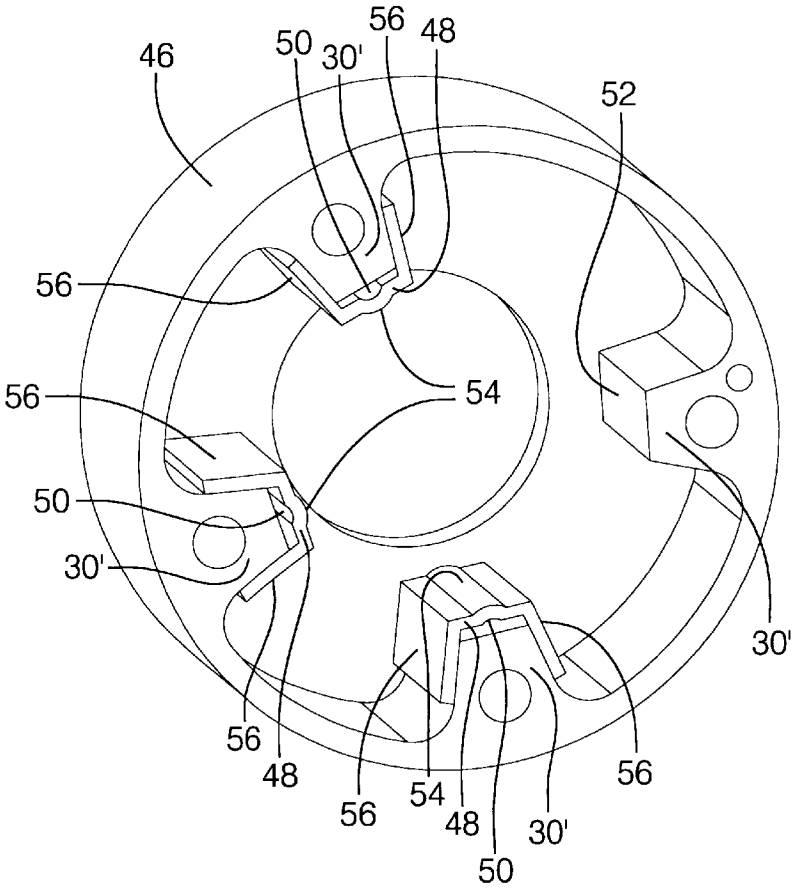
FIG. 5 is an isometric view of the inside of the integral stator and front cover plate shown in FIG. 6, showing a preferred embodiment of stator lobe seals.

Referring to FIGS. 5 and 6, a preferred embodiment of stator lobe seals is shown in integral element 46 which simplifies manufacture of the stator and reduces the cost of a phaser. Stator lobes are formed without slots 34, as shown clearly in lobe 30' in FIG. 5. Seals are provided via resilient seal "caps" 48 which are fitted over lobes 30'. Caps 48 preferably are formed, as by extrusion through an appropriately-shaped die, from a resilient polymer and are cut to length to match the axial length of the stator chambers. Caps 48 are provided with an outer longitudinal rib 50 for sealing against the tip surface 52 of lobe 30' and an inner longitudinal rib 54 for sealing against hub surface 38 of rotor 18. Caps 48 are retained in place on lobes 30' by flanges 56 extending down the sides of the lobes.

The foregoing description of the preferred embodiment of the invention has been presented for the purpose of illustration and description. It is not intended to be exhaustive nor is it intended to limit the invention to the precise form disclosed. It will be apparent to those skilled in the art that the disclosed embodiments may be modified in light of the above teachings. The embodiments described are chosen to provide an illustration of principles of the invention and its practical application to enable thereby one of ordinary skill in the art to utilize the invention in various embodiments and with various modifications as are suited to the particular use contemplated. Therefore, the foregoing description is to be considered exemplary, rather than limiting, and the true scope of the invention is that described in the following claims.

What is claimed is:

1. A vaned cam phaser for varying the cam timing of an engine, comprising:

a) a back plate;

b) a front cover plate;

c) a stator having an integral one-piece configuration with said front cover plate and disposed between said back plate and said front cover plate; and d) a rotor disposed within said stator;

wherein said stator includes a plurality of inwardly-extending spaced-apart lobes, each of said lobes having a tip surface, wherein at least one of said lobes is provided with a resilient cap seal for sealing said lobe against said rotor, said cap seal comprising, a first longitudinal raised rib for sealing against said tip surface, a second longitudinal raised rib parallel to said first rib for sealing against said rotor, and at least one flange extending along at least one side of said lobe for retaining said cap seal on said lobe.

* * * * *